US006899174B2

(12) United States Patent
Maxwell et al.

(10) Patent No.: US 6,899,174 B2
(45) Date of Patent: May 31, 2005

(54) FLOATING INSTRUMENT INSERT FOR A TOOL

(75) Inventors: Terrance Dean Maxwell, Leduc (CA); John Ransford Hardin, Jr., Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 107 days.

(21) Appl. No.: 10/404,327

(22) Filed: Apr. 2, 2003

(65) Prior Publication Data

US 2004/0194951 A1 Oct. 7, 2004

(51) Int. Cl.[7] ..... E21B 17/07

(52) U.S. Cl. ..... 166/242.7; 166/66.5; 166/117.7; 175/325.4

(58) Field of Search ..... 175/325.1–325.6; 166/66.5, 241.6, 241.7, 242.6, 242.7, 250.11, 117.7

(56) References Cited

U.S. PATENT DOCUMENTS

| | | | | |
|---|---|---|---|---|
| 3,690,166 A | * | 9/1972 | Grice | 73/84 |
| 4,031,544 A | | 6/1977 | Lapetina | |
| 5,841,734 A | | 11/1998 | Ritter et al. | |
| 6,238,142 B1 | | 5/2001 | Harsch | |
| 6,244,361 B1 | | 6/2001 | Comeau et al. | |
| 6,267,466 B1 | | 7/2001 | Gudaitis et al. | |
| 6,340,063 B1 | | 1/2002 | Comeau et al. | |
| 6,392,561 B1 | | 5/2002 | Davies et al. | |
| 6,446,736 B1 | | 9/2002 | Kruspe et al. | |
| 2001/0013411 A1 | | 8/2001 | Beck et al. | |

FOREIGN PATENT DOCUMENTS

| | | |
|---|---|---|
| WO | WO 01/27435 | 4/2001 |

* cited by examiner

*Primary Examiner*—Zakiya Walker
(74) *Attorney, Agent, or Firm*—Terrence N. Kuharchuk; William Schull; Michael D. McCully

(57) ABSTRACT

An instrument insert for a tool of the type comprising an inner member extending within an outer member, the inner and outer members being capable of relative longitudinal movement. The insert includes a first insert portion comprising a first instrument component of an instrument, a second insert portion comprising a second instrument component of the instrument and a coupling mechanism for connecting the first and second insert portions and for maintaining the first and second insert portions in a fixed relative longitudinal position. Further, the first and second insert portions are each adapted to be connected with one of the inner and outer members and the insert is adapted for mounting within the tool at a radial position between the inner and outer members such that the insert is capable of longitudinal movement relative to at least one of the inner and outer members.

22 Claims, 8 Drawing Sheets

FLOATING INSTRUMENT INSERT FOR A TOOL

FIELD OF INVENTION

The present invention relates to an instrument insert for use in a tool of the type comprising an inner member and an outer member, preferably a downhole tool including a rotatable inner member or shaft and a non-rotatable outer member or housing. More particularly, the present invention relates to a floating instrument insert mounted between the inner and outer members of the tool which compensates for slip or relative longitudinal movement between the inner and outer members.

BACKGROUND OF INVENTION

Directional drilling involves controlling the direction of a borehole as it is being drilled. Specifically, the goal of directional drilling is to reach a target subterranean destination, typically a potential hydrocarbon producing formation, with a drill string. In order to conduct the drilling operation, specialized downhole tools are utilized. These tools often include various sensors and other electronic components or equipment for providing desired information or data concerning the environmental conditions of the surrounding formation being drilled and for providing desired information or data and communicating instructions concerning the operational and directional parameters of the drill string within the borehole.

Various downhole tools typically include an inner member, such as a rotatable shaft, extending within an outer member, such as a housing. Further, various instruments may need to be mounted within the tool in the interface between the inner and outer members. For instance, the instrument provided in the interface may be comprised of a sensor for sensing the rotation or orientation of the inner member relative to the outer member.

Further, the instrument provided in the interface may be comprised of a coupling assembly or device for communicating or transmitting electrical signals or electricity along the tool between the inner and outer members. For instance, the electrical signals or electricity may embody data, instructions or sensed information being communicated between an uphole location and a downhole sensor or electronic component or may provide power being transmitted from an uphole power source to a downhole sensor or electronic component.

For example, it is often necessary or desirable to locate or position the downhole sensor within a non-rotating member or component of a tool along a rotary drill string in order to permit or facilitate the proper functioning or operation of the sensor. Accordingly, an electrical signal embodying data communications, sensed information, instructions and/or power may need to be transmitted between a non-rotating member of the tool housing containing the downhole sensor and a rotating member of the tool connected with a drive shaft or other section of the rotary drill string. Thus, an instrument comprised of a coupling assembly or device may be mounted within the interface between the rotating and non-rotating members of the tool. It is has been found to be particularly difficult to transmit power across the interface as compared with data transmission.

For instance, slip ring assemblies are often utilized for transferring power and data between rotating and non-rotating members, as described in U.S. Pat. No. 4,031,544 issued Jun. 21, 1977 to Lapetina, U.S. Pat. No. 5,841,734 issued Nov. 24, 1998 to Ritter et. al., U.S. Pat. No. 6,238,142 issued May 29, 2001 to Harsch and U.S. Pat. No. 6,392,561 issued May 21, 2002 to Davies et. al.

The slip ring assembly provides for electrical contact between a slip ring and contact brushes, each being mounted with one of the rotating and non-rotating members of a tool. The effectiveness of the transmission of the electrical signals by the slip ring assembly is dependent upon the alignment of the contact brushes with the slip ring. Given the mounting of these components with the rotating and non-rotating members of the tool, the effectiveness of the transmission of the electrical signals is therefore dependent upon the maintenance of the longitudinal alignment between the rotating and non-rotating members. In other words, any conditions or influences on the members causing relative longitudinal movement therebetween may adversely impact the slip ring assembly.

As an alternative to the use of a slip ring assembly, power transfer and data communication may be provided by inductive coupling of the rotating and non-rotating members of a tool. For instance, an electromagnetic coupling device may be provided in the interface between the rotating and non-rotating members of the tool, as described in U.S. Pat. No. 6,244,361 issued Jun. 12, 2001 to Comeau et. al. However, inductive coupling may not be desirable in some applications. Further, inductive coupling has not been found to be as effective as a slip ring assembly for the transmission of power, as compared to data communications. Finally, any instrument mounted within the interface between the rotating and non-rotating members of the tool may be adversely impacted by the relative longitudinal movement of those members.

In particular, with respect to downhole tools, conditions may be encountered in the borehole by the tool which tend to interfere with the longitudinal alignment between the inner and outer members of the tool. In particular, downhole conditions, including vibration, temperature changes, pressure changes and the application of tension and compression forces to the tool, may result in the longitudinal movement of one member relative to the other. For instance, the inner member may undergo an amount of expansion or contraction resulting in longitudinal movement relative to the outer member. Where an instrument is mounted within the interface between the inner and outer members, this relative longitudinal movement may result in a misalignment of the components of the instrument, adversely impacting the proper operation of the instrument. For example, where the slip ring assembly is mounted within the interface, the relative longitudinal movement of the inner and outer members of the tool may result in a misalignment of the slip ring and brush contacts, thus potentially interfering with data or power transmission therebetween.

Thus, there is a need in the industry for a device or apparatus for mounting an instrument in a tool of the type comprising an inner member and an outer member, wherein the inner and outer members are capable of an amount of relative longitudinal movement and wherein the instrument is required to be mounted in the interface between the members. More particularly, there is a need for the device or apparatus to be able to compensate for the slip or relative longitudinal movement of the inner and outer members of the tool in order to permit the proper functioning or operation of the instrument.

SUMMARY OF INVENTION

The present invention relates to a device or apparatus for mounting or positioning an instrument within a tool, referred to herein as an instrument insert. Further, the present invention relates to an instrument insert for use in a tool of the type comprising an inner member extending within an outer member, wherein the inner member and the outer member are capable of an amount of relative longitudinal movement. The instrument insert permits or provides for the mounting of the instrument insert within the tool at a radial position in the interface between the inner and outer members. Further, the instrument insert preferably compensates or adjusts for, or otherwise counteracts, any slip or relative longitudinal movement or reciprocation between the inner and outer members of the tool such that the proper functioning or operation of the instrument is not significantly affected or impeded thereby.

Thus, the instrument insert is provided for mounting between reciprocating inner and outer members of the tool in that the inner and outer members move longitudinally relative to each other. In addition, the instrument insert may be provided for mounting between rotating inner and outer members of the tool. In the preferred embodiment, the instrument insert is provided for mounting within the tool between the inner and outer members, wherein the members are capable of both an amount of relative longitudinal or reciprocal movement and relative rotation. Thus, in the preferred embodiment, the instrument insert does not interfere with the relative rotation between the members, while compensating or adjusting for any relative longitudinal movement.

Although the instrument insert may be used in any type of tool, apparatus or structure having inner and outer members capable of relative longitudinal movement, in the preferred embodiment of the within invention, the instrument insert is provided for use in a downhole tool for a borehole. For instance, the tool may comprise a portion of a reciprocating or rotating production or drill string. Preferably, the instrument insert is for mounting within a downhole drilling tool between a rotatable member, such as an inner rotatable shaft, and a non-rotatable member, such as an outer stationary housing.

Preferably, the instrument insert is a "floating" insert, in that the instrument insert is permitted to move longitudinally within the interface between the inner and outer members to counteract or counterbalance any relative longitudinal movement between the inner and outer members which could disrupt the operation of the instrument associated with the instrument insert. Thus, in the preferred embodiment, the instrument insert is adapted for mounting within the tool at a radial position between the inner member and the outer member such that the instrument insert is capable of longitudinal movement relative to at least one of the inner member and the outer member.

In the preferred embodiment of the invention, the invention is directed at an instrument insert for a downhole drilling tool including a rotatable inner member extending within a substantially stationary outer member. The instrument insert is adapted for mounting within the tool at a radial position between the inner and outer members in a manner such that the instrument insert is capable of longitudinal movement relative to at least one of the rotatable inner member and the stationary outer member. Thus, the instrument insert is capable of compensating for any relative longitudinal movement, such as experienced upon the contraction or expansion of the inner member downhole within the outer member as a result of downhole conditions in the borehole.

In one aspect of the invention, the invention is comprised of an instrument insert for a tool of the type comprising an inner member extending within an outer member, the inner member and the outer member being capable of an amount of relative longitudinal movement, the instrument insert comprising:

(a) a first insert portion adapted to be connected with one of the inner member and the outer member, the first insert portion comprising a first instrument component of an instrument;

(b) a second insert portion adapted to be connected with the other of the inner member and the outer member, the second insert portion comprising a second instrument component of the instrument; and (c) a coupling mechanism for connecting the first insert portion with the second insert portion and for maintaining the first insert portion and the second insert portion in a fixed relative longitudinal position;

wherein the instrument insert is adapted for mounting within the tool at a radial position between the inner member and the outer member such that the instrument insert is capable of longitudinal movement relative to at least one of the inner member and the outer member.

Any form or configuration of the instrument insert may be utilized which permits the proper functioning of the instrument associated with the instrument insert and which permits the instrument insert to move longitudinally relative to at least one of the inner member and the outer member. However, preferably, the instrument insert is comprised of the first insert portion, the second insert portion and the coupling mechanism as noted above.

Further, the first insert portion and the second insert portion may be coupled in any manner and by any mechanism capable of, and suitable for, connecting the portions to maintain the first and second portions in a fixed relative longitudinal position. As a result, the first instrument component and the second instrument component comprising the first and second insert portions respectively are also maintained in a fixed relative longitudinal position.

In addition, any of the components of the instrument insert may be adapted for mounting within the tool to permit the desired longitudinal movement relative to at least one of the inner member and the outer member. However, in the preferred embodiment, at least one of the first insert portion and the second insert portion is adapted to be connected with one of the inner and outer members of the tool to provide for the relative longitudinal movement.

Thus, upon any relative longitudinal movement of the inner and outer members of the tool, the first and second insert portions are maintained in a fixed relative longitudinal position such that the instrument insert moves longitudinally as a unit or as a integral member relative to at least one of the inner and outer members.

As stated, with respect to the tool, the inner member extends within the outer member and the inner member and the outer member are capable of an amount of relative longitudinal or reciprocal movement. Further, preferably, the inner member and the outer member are capable of relative rotation. Thus, the instrument insert is preferably mounted within the tool at a radial position between the inner member and the outer member wherein the inner and outer members are capable of relative longitudinal movement and relative rotation. The instrument insert may be mounted within any tool providing the inner and outer members.

The first insert portion is preferably adapted to be connected with one of the inner member and the outer member, while the second insert portion is adapted to be connected with the other of the inner member and the outer member. The first and second insert portions may be adapted to be connected to the inner and outer members in any manner and by any mechanism or structure capable of, and suitable for, permitting the desired relative movements between the inner and outer members, longitudinally and preferably rotatably, while also permitting the coupling mechanism to maintain the first and second insert portions in the fixed relative longitudinal position.

In the preferred embodiment, wherein the inner member and the outer member are capable of relative rotation, the first insert portion is adapted to be non-rotatably connected with one of the inner member and the outer member and the second insert portion is adapted to be non-rotatably connected with the other of the inner member and the outer member. Further, the coupling mechanism is comprised of at least one bearing so that relative rotation of the inner member and the outer member results in relative rotation of the first insert portion and the second insert portion.

Although the coupling mechanism is preferably comprised of at least one bearing, and more preferably two, the coupling mechanism may be comprised of any device or structure which is capable of, and suitable for, connecting and maintaining the first and second insert portions in the fixed relative longitudinal position, while also permitting relative rotation between the first and second insert portions. Thus, although the first and second instrument components of the instrument comprising the first and second insert portions are permitted to rotate relative to each other with rotation of the inner and outer members of the tool, the first and second instrument components are maintained in longitudinal alignment to permit or facilitate the proper functioning of the instrument.

Further, the first insert portion may be adapted to be non-rotatably connected with either of the inner and outer members, while the second insert portion is adapted to be non-rotatably connected with the other of the inner and outer members. However, in the preferred embodiment, the first insert portion is adapted to be non-rotatably connected with the inner member and the second insert portion is adapted to be non-rotatably connected with the outer member. Accordingly, where the inner member rotates within a substantially stationary outer member, the first insert portion rotates with the inner member, while the second insert portion remains substantially stationary with the outer member.

Further, as indicated, the instrument insert is adapted for mounting in the tool such that the instrument insert is capable of longitudinal or reciprocal movement relative to at least one of the inner member and the outer member. Although the instrument insert may be adapted in any manner to permit this movement, the first and second insert portions are preferably particularly adapted to permit the relative longitudinal movement. More particularly, at least one of the inner insert portion and the outer insert portion is reciprocably connected with one of the inner member and the outer member of the tool such that the instrument insert is capable of longitudinal movement relative to that member. In other words, at least one of the inner insert portion and the outer insert portion is connected with one of the inner member and the outer member of the tool in a manner to permit reciprocal or longitudinal movement relative to that member.

Further, in the preferred embodiment, where the first insert portion is connected with the inner member and the second insert portion is connected with the outer member, the first and second insert portions may both be reciprocably connected with the inner and outer members respectively. However, preferably, one of the first insert portion and the second insert portion is reciprocably connected with its respective inner or outer member, while the other of the first insert portion and the second insert portion is non-reciprocably connected with its respective inner or outer member. Accordingly, the instrument insert is capable of longitudinal or reciprocating movement relative to one of the inner member and the outer member only.

In the preferred embodiment, the first insert portion is adapted to be non-reciprocably connected with the inner member so that the first insert portion moves longitudinally with the inner member and the second insert portion is adapted to be reciprocably connected with the outer member so that the second insert portion moves longitudinally with the first insert portion, whereby the instrument insert is capable of longitudinal movement relative to the outer member.

Thus, in the preferred embodiment, the first insert portion is adapted to be non-rotatably and non-reciprocably connected with the inner member and the second insert portion is adapted to be non-rotatably and reciprocably connected with the outer member. Accordingly, where the inner member rotates within a substantially stationary outer member, the first insert portion rotates and moves longitudinally as a unit with the inner member, while the second insert portion remains substantially stationary rotationally with the outer member but is permitted to reciprocate longitudinally relative to the outer member. As a result, the instrument insert moves longitudinally as a unit with the inner member relative to the outer member, while the first and second instrument components of the instrument are permitted to rotate relative to each other but are maintained in a fixed relative longitudinal position.

Preferably, the instrument insert is further comprised of a first connecting mechanism for non-rotatably and non-reciprocably connecting the first insert portion with the inner member. The first connecting mechanism may be comprised of any device, mechanism, structure or combinations thereof capable of, and suitable for, both non-rotatably and non-reciprocably mounting, connecting, affixing or otherwise attaching the first insert portion with the inner member.

However, preferably, the first insert portion is comprised of a mounting sleeve, wherein the mounting sleeve is adapted to surround the inner member. Further, the first connecting mechanism is associated with the mounting sleeve for non-rotatably and non-reciprocably connecting the mounting sleeve with the inner member. In the preferred embodiment, the first connecting mechanism is comprised of a locking ring or taper lock circumferentially fastened about the mounting sleeve for fixedly connecting the mounting sleeve with the inner member.

Preferably, the instrument insert is also further comprised of a second connecting mechanism for non-rotatably and reciprocably connecting the second insert portion with the outer member. The second connecting mechanism may be comprised of any device, mechanism, structure or combinations thereof capable of, and suitable for, both non-rotatably and reciprocably mounting, connecting, affixing or otherwise attaching the second insert portion with the outer member.

However, preferably, the second insert portion is comprised of an outer insert housing, wherein the second connecting mechanism is comprised of one of a key and a keyway associated with the outer insert housing which is adapted to engage a complementary structure associated with the outer member for non-rotatably and reciprocably connecting the outer insert housing with the outer member. In the preferred embodiment, a keyway is associated with the outer insert housing for engaging a complementary key structure associated with the outer member. The keyway of the outer insert housing is configured and oriented to permit movement of the key therein longitudinally but not rotationally or circumferentially relative to the second insert portion.

The instrument comprising the first and second instrument components may be any type of mechanical and/or electronic or electrical mechanism, device or apparatus desired to be mounted within the tool. However, the within invention is particularly applicable where the instrument is of a type including a first instrument component and a second instrument component which are preferably maintained in a fixed relative longitudinal position in order to facilitate or ensure the proper functioning of the instrument and which is required or desired to be mounted between inner and outer members of a tool capable of longitudinal movement relative to each other. Further, the within invention is particularly applicable where the instrument is required or desired to be mounted between inner and outer members of a tool capable of both longitudinal movement and rotation relative to each other.

In one embodiment, the instrument is comprised of a rotation sensor apparatus for sensing the relative rotation of the inner member and the outer member. In this embodiment, the first instrument component is comprised of at least one magnet, the second instrument component is comprised of a magnetic sensor for sensing the proximity of the magnet to the magnetic sensor, and wherein the first insert portion and the second insert portion are connected such that the magnetic sensor is capable of sensing the proximity of the magnet to the magnetic sensor.

In a further embodiment, the instrument is comprised of a slip ring assembly for transmitting electricity between the inner member and the outer member. In this application, a reference to "electricity" or an "electrical signal" includes the transmission or provision of signals embodying or incorporating either or both data communications and power. In this further embodiment, the first instrument component is comprised of a conductive slip ring, wherein the second instrument component is comprised of an electrical contact assembly for providing an electrical contact with the slip ring, and wherein the first insert portion and the second insert portion are connected such that the slip ring engages with the electrical contact assembly. In other words, the "electrical contact" permits the transmission or communication of the electricity or electrical signal between the components.

Further, the first insert portion and the second insert portion of the instrument insert are comprised of a first instrument component and a second instrument component respectively of an instrument, such as the rotation sensor apparatus and the slip ring assembly. Thus, although the instrument insert is comprised of at least one instrument, it may also be comprised of a plurality of instruments. In other words, the first insert portion may be comprised of a plurality of first instrument components of a plurality of instruments and the second insert portion may be comprised of a plurality of second instrument components of the plurality of instruments. Preferably, each of the plurality of instruments is comprised of a first instrument component and a compatible second instrument component. Thus, for example, in the preferred embodiment, the instrument insert is comprised of two instruments, a first instrument comprised of the rotation sensor apparatus and a second instrument comprised of the slip ring assembly.

Finally, in order to facilitate or enhance the proper operation or functioning of the instrument or instruments of the instrument insert, any fluid passing within the instrument insert is preferably filtered to restrict the passage of any debris or other deleterious matter into the instrument insert to the instrument. Therefore, the instrument insert is preferably comprised of a filtering mechanism. In the preferred embodiment, the second insert portion is further comprised of an outer insert housing, wherein the outer insert housing is comprised of a filter mechanism for filtering a fluid as the fluid passes from an exterior of the outer insert housing to an interior of the outer insert housing. However, any suitable type, configuration or structure of the filtering mechanism capable of filtering the fluid may be used.

SUMMARY OF DRAWINGS

Embodiments of the invention will now be described with reference to the accompanying drawings, in which.

DETAILED DESCRIPTION

Figure 1:
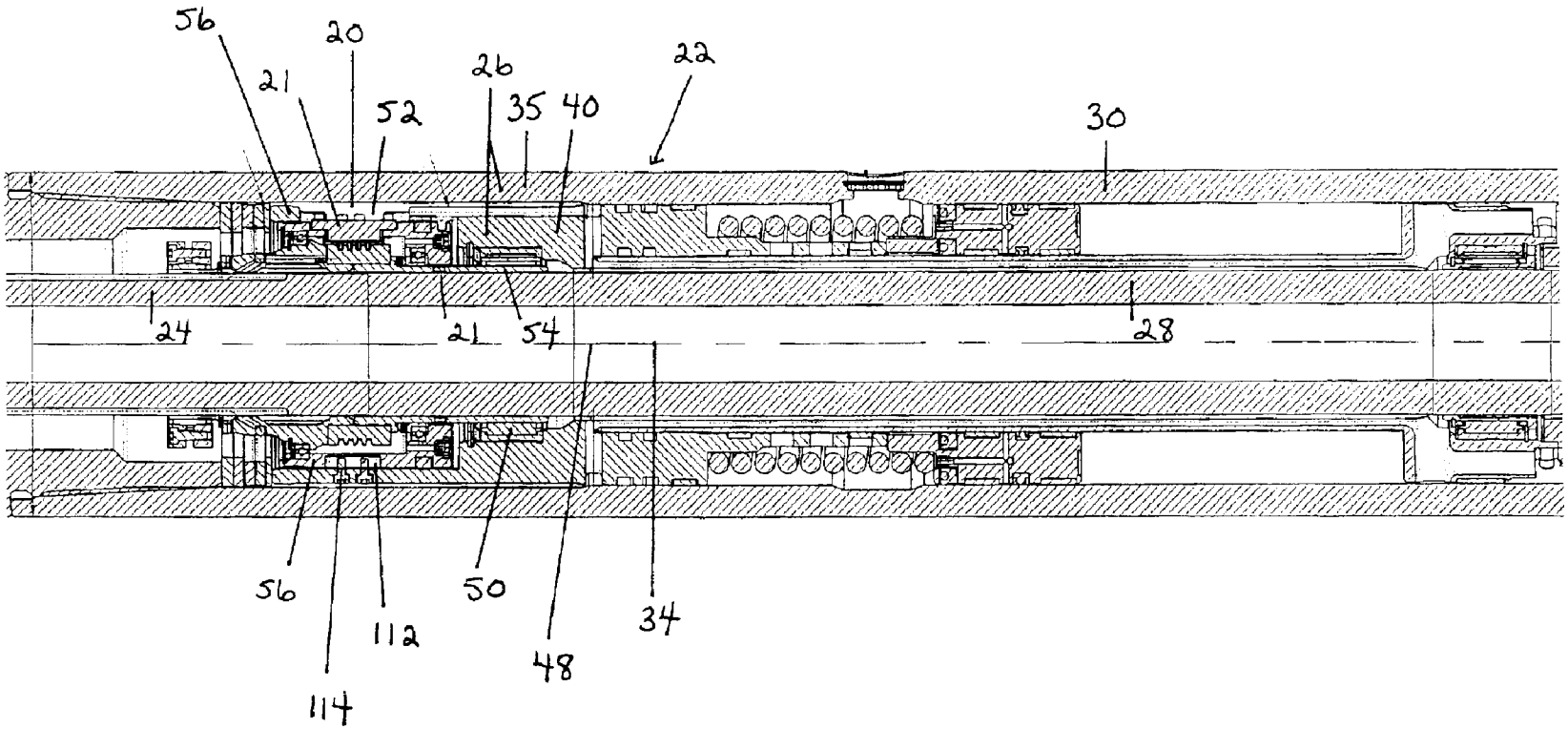
FIG. 1 is a longitudinal sectional view of a preferred embodiment of an instrument insert mounted within an inner member and an outer member of a tool.
Figure 2:
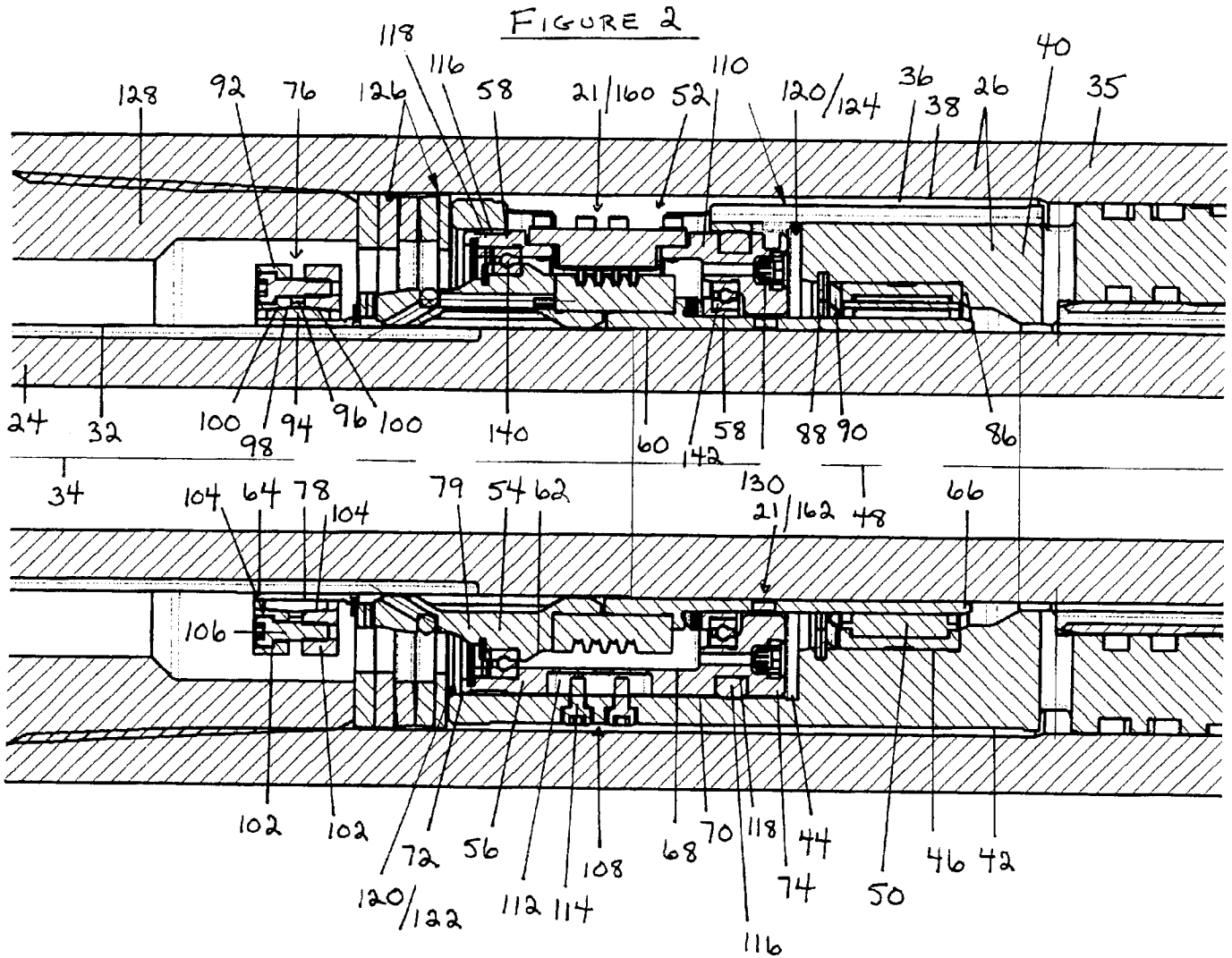
FIG. 2 is a more detailed portion of the longitudinal sectional view of the instrument insert within the tool as shown in FIG. 1.
Figure 3:
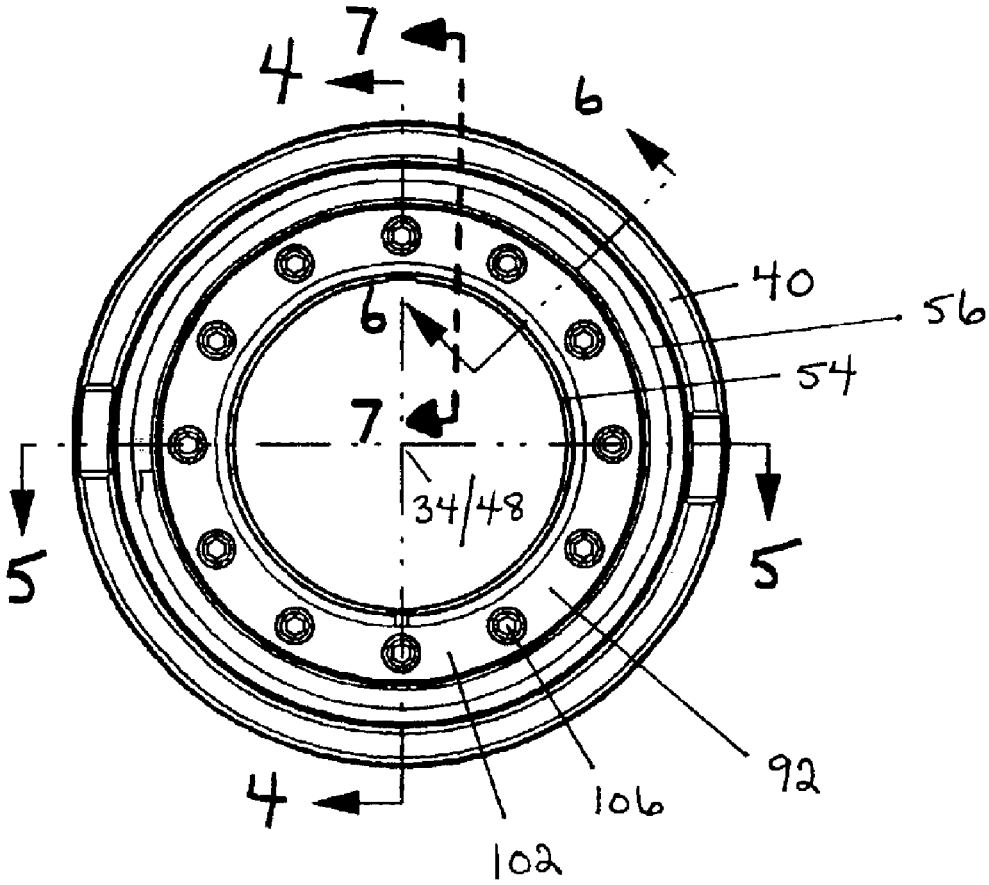
FIG. 3 is an end view of the instrument insert and a portion of the outer member of the tool shown in FIG. 1.

Referring to FIGS. 1 and 2, the invention is directed at an instrument insert (20) for a tool (22), wherein the instrument insert (20) is associated with or comprised of an instrument (21) as described herein. The instrument insert (20) is particularly for use in a tool (22) of the type comprising an inner member (24) extending within an outer member (26), wherein the inner member (24) and the outer member (26) are capable of an amount of relative longitudinal movement. Longitudinal movement or reciprocal or reciprocating movement is movement in the direction of the longitudinal axes of the inner and outer members (24, 26). Further, although not required, in the preferred embodiment, the inner member (24) and the outer member (26) are also capable of relative rotation.

The instrument insert (20) may be used in any tool (22) of the type described. However, the instrument insert (20) is preferably used in a downhole tool for insertion in a borehole. More particularly, the downhole tool is preferably a downhole drilling tool. Specifically, the tool is preferably incorporated into or comprises a portion or section of a drill string which extends from the surface within the borehole.

Preferably, the tool (22) is incorporated in or comprises a portion or section or the whole of a drilling direction control device for orienting a drilling system downhole, such as a rotary drilling system. In the preferred embodiment, the tool

(22) is comprised of the drilling direction control device described in U.S. Pat. No. 6,244,361 issued Jun. 12, 2001 to Comeau et. al. The drilling direction control device, and thus the tool (22), is comprised of a rotatable shaft (28) which is connectable with the drill string and a housing (30) for rotatably supporting a length of the shaft (28) for rotation therein. A portion of the tool (22) having the instrument insert (20) mounted therein is shown in FIGS. 1 and 2.

Thus, in the preferred embodiment, the inner member (24) is comprised of the rotatable shaft (28) while the outer member (26) is comprised of the housing (30). To permit or facilitate the relative rotation between the inner and outer members (24, 26), being comprised of the rotatable shaft (28) and the housing (30) respectively, the outer member (26) may be associated with a device (not shown) for restraining the rotation of the outer member (26) upon rotation of the inner member (24), such as during the drilling operation. Preferably, the outer member (26) is maintained or restrained rotationally in a substantially stationary position.

Referring to FIGS. 1 and 2, the inner member (24) extends within the outer member (26). The inner member (24) of the tool (22) may be comprised of a single element or component or may be comprised of a plurality of elements, sections or components connected, fastened or otherwise fixedly joined together to form the inner member (24). In the preferred embodiment, the inner member (24) is comprised of an elongate member, such as the rotatable shaft (28), having an outer circumferential or perimetrical surface (32) and defining a longitudinal axis (34) extending therethrough.

Similarly, the outer member (26) of the tool (22) may be comprised of a single element or component or may be comprised of a plurality of elements, sections or components connected, fastened or otherwise fixedly joined together to form the outer member (26). In the preferred embodiment, the outer member (26) is comprised of a plurality of elements or sections which are fixedly or rigidly connected or affixed together to move as a unit. In particular, the outer member (26) is comprised of an elongate and substantially tubular or cylindrical housing member (35), such as the housing (30), having a bore (36) defining an inner circumferential or perimetrical surface (38) therein.

In addition, the outer member (26) is further comprised of at least one housing insert (40) contained within the bore (36) of the housing member (35) and fixedly and non-rotatably connected with the housing member (35). The housing insert (40) is comprised of an elongate and substantially tubular or cylindrical member having an outer circumferential or perimetrical surface (42) which is affixed, mounted or fastened with the inner surface (38) of the housing member (35). Further, the housing insert (40) has a bore (44) defining an inner circumferential or perimetrical surface (46) therein. The housing member (35) and the housing insert (40) together define a longitudinal axis (48) of the outer member (26) extending therethrough.

Preferably, the longitudinal axis (34) of the inner member (24) is coincident or concurrent with the longitudinal axis (48) of the outer member (26). A reference to longitudinal movement herein refers to movement along or in the direction of the longitudinal axes (34, 48). Further, the inner member (24) extends within and is supported by the outer member (26) such that an amount of relative longitudinal movement is permitted therebetween. Further, in the preferred embodiment, the inner member (24) is supported by the outer member (26) such that the inner member (24) and the outer member (26) are capable of relative rotational movement about their longitudinal axes (34, 48). Any mechanism, apparatus, device or structure capable of rotationally supporting the inner member (24) within the outer member (26) in the described manner may be used. For instance, one or more radial bearings (50) may be provided between the inner and outer members (24, 26) for rotationally supporting and centralizing the inner member (24) within the outer member (26).

Finally, the inner member (24) is supported within the outer member (26) such that a radial space or gap (52) is provided between the inner and outer members (24, 26) for positioning of the instrument insert (20) therein. Preferably, the radial space (52) is provided between the outer surface (32) of the inner member (24) and the inner surface (40) of the housing insert (40) comprising the outer member (26). As indicated, the instrument insert (20) is mounted within the tool (22) at a radial position, preferably within the radial space (52), between the inner and outer members (24, 26).

Referring to FIGS. 1–8, the instrument insert (20) is comprised of a first insert portion (54), a second insert portion (56) and a coupling mechanism (58). The first insert portion (54) is adapted to be connected with one of the inner member (24) and the outer member (26) of the tool (22), while the second insert portion (56) is adapted to be connected with the other of the inner member (24) and the outer member (26).

In the preferred embodiment, the first insert portion (54) is adapted to be connected with the inner member (24). The first insert portion (54) may have any shape or configuration compatible for connecting with the inner member (24) in the desired manner as described herein. However, preferably, the first insert portion (54) is substantially tubular or cylindrical defining a circumferential inner surface (60), an outer surface (62) and opposed first and second ends (64, 66). The inner surface (60) of the first insert portion (54) is preferably sized for receipt of the inner member (24) of the tool (22) therein. Further, the inner surface (60) of the first insert portion (54) is preferably particularly adapted to be connected with the adjacent outer circumferential surface (32) of the inner member (24).

Further, in the preferred embodiment, the second insert portion (56) is adapted to be connected with the outer member (26). The second insert portion (56) may have any shape or configuration compatible for connecting with the outer member (26) in the desired manner as described herein. However, preferably, the second insert portion (56) is also substantially tubular or cylindrical defining an inner surface (68), a circumferential outer surface (70) and opposed first and second ends (72, 74). The second insert portion (56) is sized or configured for receipt of at least a part of the first insert portion (54) therein Further, the second insert portion (56) is preferably sized or configured for receipt within the outer member (26), particularly the housing insert (40). Thus, the outer surface (70) of the second insert portion (56) is preferably particularly adapted to be connected with the adjacent inner surface (46) of the housing insert (40) comprising the outer member (26).

As stated, the instrument insert (20) is adapted for mounting within the radial space (52) such that the instrument insert (20) is capable of longitudinal movement relative to at least one of the inner member (24) and the outer member (26). Thus, one of the first inert portion (54) and the second insert portion (56) is capable of longitudinal movement relative to at least one of the inner member (24) and the outer member (26).

In the preferred embodiment, the instrument insert (20) is adapted for mounting such that the instrument insert (20) is capable of longitudinal movement relative to the outer member (26) alone. Thus, the first insert portion (54) is adapted to be non-reciprocably connected with the inner member (24) so that the first insert portion (54) moves longitudinally, or reciprocates along the longitudinal axis (34), with the inner member (24). Further, the second insert portion (56) is adapted to be reciprocably connected with the outer member (26) so that the second insert portion (56) moves longitudinally or reciprocates with the first insert portion (54) as a result of the coupling mechanism (58) which maintains the first insert portion (54) and the second insert portion (56) in a fixed relative longitudinal position. In other words, the second insert portion (56) moves longitudinally, or reciprocates along the longitudinal axis (48), relative to the outer member (26).

More particularly, in the preferred embodiment, the inner surface (60) of the first insert portion (54) is adapted to be non-reciprocably connected with the adjacent outer surface (32) of the inner member (24), while the outer surface (70) of the second insert portion (56) is adapted to be reciprocably connected with the adjacent inner surface (46) of the housing insert (40). In other words, the first insert portion (54) is connected with the inner member (24) in a manner inhibiting or preventing any relative longitudinal or reciprocal movement therebetween, while the second insert portion (56) is connected with the housing insert (40) in a manner permitting an amount of relative longitudinal or reciprocal movement therebetween.

In addition, in the preferred embodiment, the inner and outer members (24, 26) of the tool (22) are capable of relative rotation. Further, each of the first insert portion (54) and the second insert portion (56) is further adapted to be non-rotatably connected with one of the inner member (24) and the outer member (26). Thus, in the preferred embodiment, the inner surface (60) of the first insert portion (54) is adapted to be non-reciprocably and non-rotatably connected with the adjacent outer surface (32) of the inner member (24), while the outer surface (70) of the second insert portion (56) is adapted to be reciprocably and non-rotatably connected with the adjacent inner surface (46) of the housing insert (40).

The first insert portion (54) may be adapted to non-rotatably and non-reciprocably connect with the inner member (24) in any manner and by any mechanism, device or structure capable of restraining or preventing any relative rotation or longitudinal movement between the first insert portion (54) and the inner member (24). Referring to FIGS. 1, 2 and 4–6, in the preferred embodiment, the instrument insert (20) is further comprised of a first connecting mechanism (76) for non-rotatably and non-reciprocably connecting the first insert portion (54) and the inner member (24). More particularly, the first connecting mechanism (76) fixedly or rigidly connects, attaches, fastens or otherwise mounts, either permanently or removably and either directly or indirectly, the inner surface (60) of the first insert portion (54) with the outer surface (32) of the inner member (24).

The first insert portion (54) may be comprised of a single member, component or element providing an integral unit. However, preferably, the first insert portion (54) is comprised of a plurality of members, components or elements connected, fastened or otherwise retained together to define the first insert portion (54). For instance, in the preferred embodiment, the first insert portion (54) is comprised of an inner mounting sleeve (78) and an outer sleeve (79). The inner mounting sleeve (78) comprises or defines the inner surface (60) of the first insert portion (54) and extends between the first and second ends (64, 66). The mounting sleeve (78) has a tubular configuration or structure and is adapted to surround the inner member (24) such that the inner member (24) is receivable therein. The outer sleeve (79) comprises or defines at least a portion of the outer surface (62) of the first insert portion (54) and also has a tubular configuration or structure such that it is adapted to surround a portion of the mounting sleeve (78) between the first and second ends (64, 66).

Figure 7:
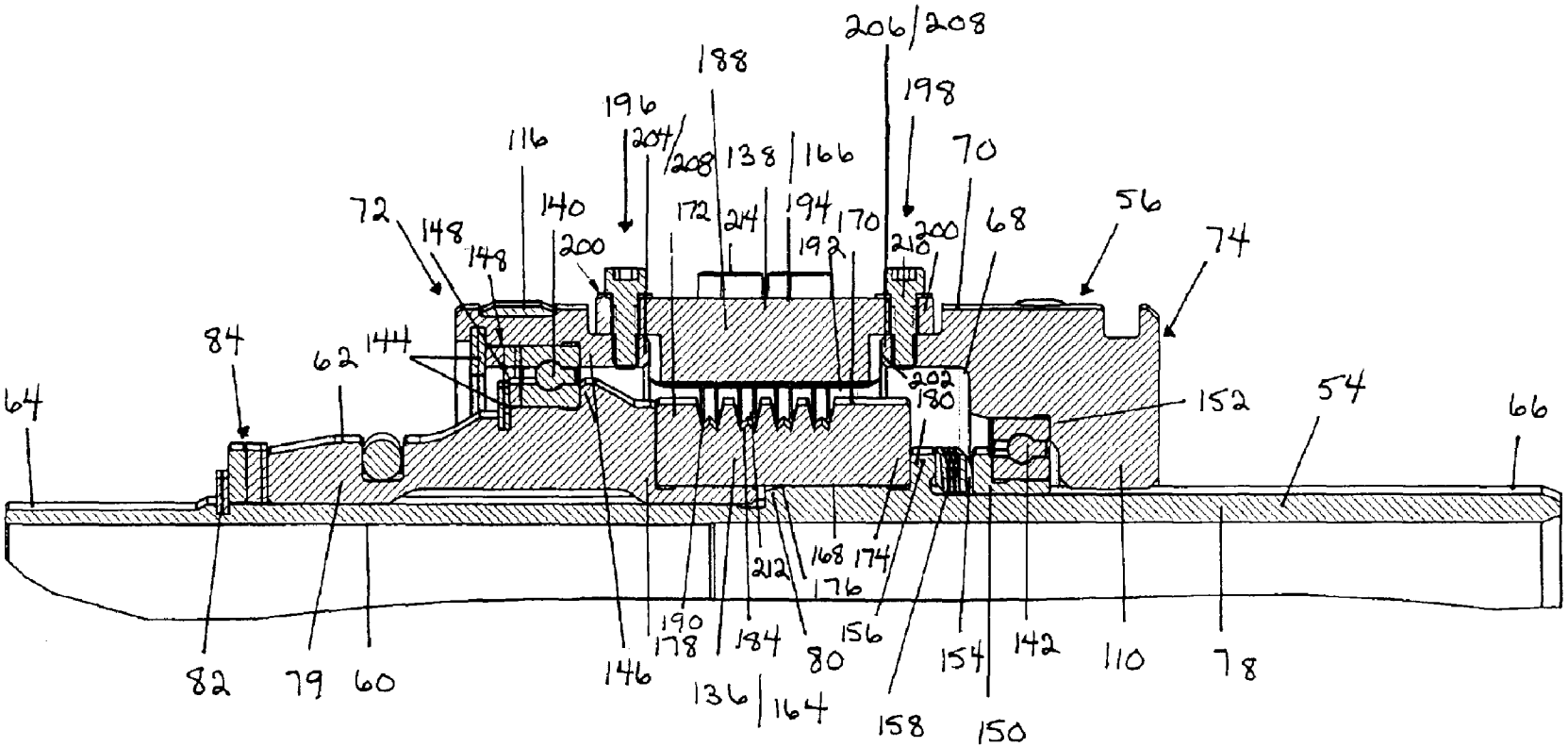
FIG. 7 is a longitudinal sectional view of the instrument insert in isolation taken along line 7—7 of FIG. 3.

Referring particularly to FIG. 7, in the preferred embodiment, the outer sleeve (79) is provided for carrying or retaining various components or elements of the first insert portion (54) as discussed below. The outer sleeve (79) may be retained in a desired position or location relative to the mounting sleeve (78) by an retaining structure or device. However, preferably, the outer sleeve (79) is retained in position about the mounting sleeve (78) between a shoulder (80) defined by the mounting sleeve (78) and a retaining ring (82) extending about the mounting sleeve (78). One or more spacers (84) may also be used as desired or required to obtain or retain the desired positioning of the outer sleeve (79) on the mounting sleeve (78). In other words, the outer sleeve (79) is retained in abutment between the shoulder (80) of the mounting sleeve (78) and the retaining ring (82) with one or more spacers (84) as required.

Further, the first insert portion (54) and the second insert portion (56) are maintained in a fixed relative longitudinal position by the coupling mechanism (58). Although the first insert portion (54) and the second insert portion (56) may be maintained in any fixed positions relative to each other, the second insert portion (56) is preferably fixed about all or a part of the first insert portion (54) such that at least a part of the outer surface (62) of the first insert portion (54) is opposed or adjacent to at least a part of the inner surface (68) of the second insert portion (56). In the preferred embodiment, the second insert portion (56) is fixed in a position about the first insert portion (54) such that the first and second ends (64, 66) of the first insert portion (54) extend from the first and second ends (72, 74) of the second insert portion (56) respectively. Specifically, the mounting sleeve (78), defining the first and second ends (64, 66) of the first insert portion (54), extends from the first and second ends (72, 74) of the second insert portion (56).

The first connecting mechanism (76) is preferably associated with the mounting sleeve (78) for non-rotatably and non-reciprocably connecting the mounting sleeve (78) with the inner member (24). The first connecting mechanism (76) may be associated with the mounting sleeve (78) at any position or location along its length between the first and second ends (64, 66) of the first insert portion (54). However, preferably, the first connecting mechanism (76) is associated with the mounting sleeve (78) at one of the first and second ends (64, 66) of the first insert portion (54). In the preferred embodiment, the first connecting mechanism (76) is associated with the mounting sleeve (78) at the first end (64) where the mounting sleeve (78) extends from the first end (72) of the second insert portion (56).

In addition, as noted above, at least one radial bearing (50) may be provided between the inner and outer members (24, 26) for rotationally supporting and centralizing the inner member (24) within the outer member (26), as shown in FIGS. 2 and 4–6. In the preferred embodiment, the second end (66) of the first insert portion (54) comprised of the mounting sleeve (78) extends from the second end (74) of the second insert portion (56) to a position adjacent the housing insert (40) comprising the outer member (26). In other words, the mounting sleeve (78), at the second end (66) of the first insert portion (54), is positioned or located between the outer surface (32) of the inner member (24) and the inner surface (46) of the housing insert (40). Given that the mounting sleeve (78) is fixed with the inner member (24), the mounting sleeve (78) rotates relative to the housing insert (40).

As a result, in the preferred embodiment, at least one radial bearing (50) is positioned between the mounting sleeve (78), at the second end (66) of the first inert portion (54), and the adjacent inner surface (46) of the housing insert (40). The radial bearing (50) may be maintained in the desired position between the mounting sleeve (78) and the housing insert (40) by any mechanism or structure. However, in the preferred embodiment, the radial bearing (50) is maintained in abutment with a shoulder (86) defined by the inner surface (46) of the housing insert (40). Specifically, the radial bearing (50) is held or maintained between the shoulder (86) and a retaining ring (88) mounted with, and extending from, the inner surface (46) of the housing insert (40). Finally, in order to maintain the bearing (50) in the desired position upon longitudinal movement of the inner member (24), the bearing (50) is urged away from the retaining ring (88) and into abutment with the shoulder (86) by a biasing mechanism or device, such as a spring (90). In the preferred embodiment, the spring (90) is comprised of at least one wave spring.

Preferably, the first connecting mechanism (76) is comprised of any mechanism, device or structure capable of fixedly or rigidly connecting, attaching or otherwise fastening the mounting sleeve (78) about the inner member (24). Referring to FIGS. 1, 2 and 4–6, in the preferred embodiment, the first connecting mechanism (76) is comprised of a taper lock (92), also referred to as a locking ring. In the preferred embodiment, the taper lock (92) is comprised of a three piece taper lock for tightening or cinching the mounting sleeve (78) about the inner member (24).

The taper lock (92) is comprised of a circumferential inner ring (94) which is mounted about the mounting sleeve (78) at, adjacent or in proximity to the first end (64) of the first insert portion (54). Although the inner ring (94) may be mounted in any manner, preferably, the inner ring (94) is mounted by a plurality of screws or bolts (96) extending between the inner ring (94) and the mounting sleeve (78) and spaced about the circumference of the inner ring (94). Further, the inner ring (94) has an upper surface (98) defining two sloping or tapered portions (100) which each slope or taper outwardly away from a center of the upper surface (98) in an inward direction towards the mounting sleeve (78), as shown in the Figures.

The taper lock (92) is further comprised of two opposed circumferential outer rings (102) which surround the inner ring (94). Each outer ring (102) has a lower surface (104) which defines a compatible slope or taper for engagement with one of the tapered portions (100) of the upper surface (98) of the inner ring (94). When the outer rings (102) are mounted in position about the inner ring (94), the screws (96) mounting the inner ring (94) with the mounting sleeve (78) are positioned between the outer rings (102). Further, the tapered portions (100) of the upper surface (98) of the inner ring (94) engage the tapered lower surfaces (104) of the outer rings (102). Finally, a plurality of bolts or screws (106) extend between the opposed outer rings (102). Tightening of the bolts (106) draws the outer rings (102) into closer proximity to each other, which moves the lower surface (104) of each outer ring (102) along the tapered portions (100) of the inner ring (94) to cause the mounting sleeve (78) to more closely or firmly engage the inner member (24).

The second insert portion (56) may be adapted to non-rotatably and reciprocably connect with the outer member (26) in any manner and by any mechanism, device or structure capable of restraining or preventing any relative rotation, while permitting an amount of longitudinal movement, between the second insert portion (56) and the outer member (26). In the preferred embodiment, the instrument insert (20) is further comprised of a second connecting mechanism (108) for non-rotatably and reciprocably connecting the second insert portion (56) and the outer member (26). More particularly, the second connecting mechanism (108) connects, attaches, fastens or otherwise mounts in the desired manner, either permanently or removably and either directly or indirectly, the outer surface (70) of the second insert portion (56) with the inner surface (46) of the outer member (26), particularly the housing insert (40).

The second insert portion (56) may be comprised of a single member, component or element providing an integral unit or a plurality of members, components or elements connected, fastened or otherwise retained together to define the second insert portion (56). In the preferred embodiment, the second insert portion (56) is comprised of an outer insert housing (110). Preferably, the outer insert housing (110) comprises or defines both the inner and outer surfaces (68, 70) of the second insert portion (56) and extends between the first and second ends (72, 74). The outer insert housing (110) preferably has a tubular configuration or structure and is adapted to surround the first insert portion (54) between the first and second ends (64, 66) thereof, as discussed above, such that the first insert portion (54) extends through the outer insert housing (110).

In the preferred embodiment, the outer insert housing (110) may be retained in a desired position or location relative to the first insert portion (54) by any retaining structure or device. However, preferably, the outer insert housing (110) is retained in position about the first insert portion (54) by the coupling mechanism (58) as described in detail below.

Figure 4:
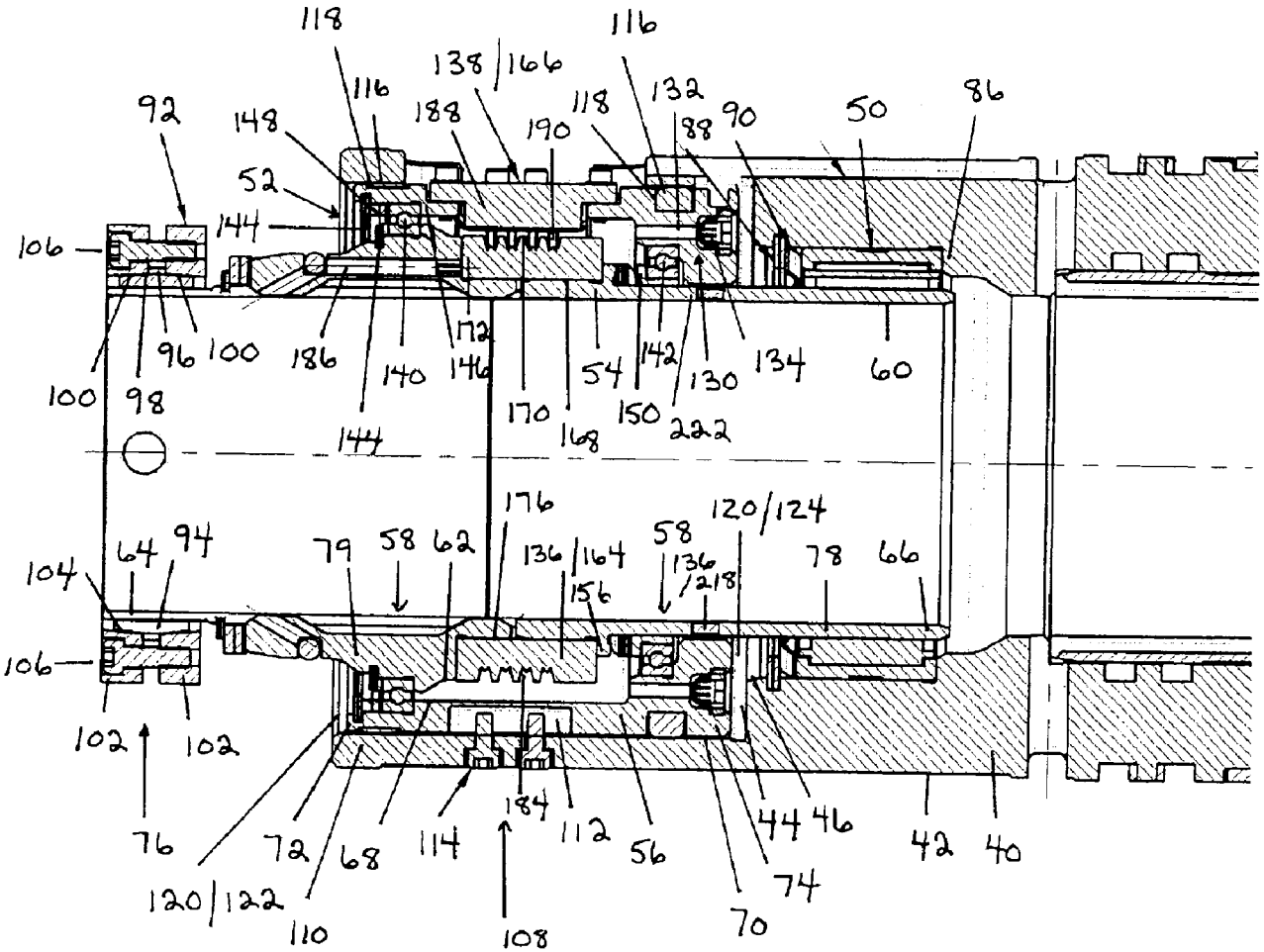
FIG. 4 is a longitudinal sectional view of the instrument insert and the portion of the outer member of the tool taken along line 4—4 of FIG. 3.

Referring to FIGS. 1, 2 and 4, the second connecting mechanism (108) is preferably associated with the interface between outer insert housing (110), defining the outer surface (70) of the second insert portion (56), and the housing insert (40), defining the inner surface (46) of the outer member (26). Specifically, the second connecting mechanism (108) is comprised of complementary or compatible structures on each of the adjacent surfaces of the outer insert housing (110) and the housing insert (40) for non-rotatably and reciprocably connecting the outer insert housing (108) with the housing insert (40). Any complementary or compatible structures capable of providing the desired non-rotatable, reciprocable connection may be used, such as complementary longitudinally oriented splines and grooves or complementary key and keyway structures.

The second connecting mechanism (108) may be associated with the outer insert housing (110) at any position or location along its length between the first and second ends (72, 74) of the second insert portion (56). However, preferably, the second connecting mechanism (108) is associated with the outer insert housing (110) at about a mid-point between, or approximately centrally of, the first and second ends (72, 74).

Referring to FIGS. 1, 2 and 4, preferably, the second connecting mechanism (108) is comprised of one of a key and a keyway associated with the outer insert housing (110) which is adapted to engage a complementary structure associated with the outer member (26), particularly the housing insert (40), for non-rotatably and reciprocably connecting the outer insert housing (110) with the outer member (26). In the preferred embodiment, at least one elongate, longitudinally oriented keyway (112), being a groove or slot, is defined by the outer surface (70) of the outer insert housing (110) of the second insert portion (56). Each keyway (112) is provided for receiving at least one complementary key (114) structure therein. Each key (114) is fixedly mounted or fastened with, and extends from, the inner surface (46) of the housing insert (40). In the preferred embodiment, two keys (114) extend from the housing insert (40) for receipt within a single keyway (112) defined by the outer insert housing (110). However, any number of keyways (112) and complementary keys (114) may be used as desired or required for a particular application. Further, in the preferred embodiment, each key (114) is particularly comprised of a capscrew having an end extending from the housing insert (40) to act as or provide the key structure (114).

In addition, a device or structure may be further provided in the interface between the outer insert housing (110) and the housing insert (40) for facilitating the longitudinal movement between the instrument insert (20) and the outer member (26) and for assisting with the centralization of the instrument insert (20) within the outer member (26). In the preferred embodiment, at least one circumferential glide button or glide ring (116) is mounted with at least one groove (118) defined by the outer surface (70) of the outer insert housing (110) for engaging the adjacent surface of the housing insert (40).

When the first insert portion (54) and the second insert portion (56) are coupled to form the instrument insert (20) and the instrument insert (20) is positioned within the radial space (52) provided between the inner and outer members (24, 26) of the tool (22), the other components of the tool (22) must be positioned within the tool (22) adjacent to the instrument insert (20) in a manner permitting any necessary or required longitudinal movement of the instrument insert (20) consequent upon the relative longitudinal movement of the inner and outer members (24, 26). Thus, the radial space (52) provided for the instrument insert (20) has a length sufficient to accommodate the instrument insert (20) and to accommodate any necessary or required longitudinal movement of the instrument insert (20).

More particularly, referring to FIGS. 2 and 4–6, an axial or longitudinal gap (120) is provided in the radial space (52) between the instrument insert (20) and the other components of the tool (22) located or positioned longitudinally at either end of the instrument insert (20). The total amount or length of the longitudinal gap (120) determines the amount of longitudinal movement or travel permitted by the instrument insert (20) relative to the outer member (26). The total amount or length of the longitudinal gap (120) is equal to the combined amounts or lengths of the longitudinal gaps at either end of the instrument insert (20). For instance, in the preferred embodiment, when assembling the instrument insert (20) within the tool (22), the instrument insert (20) is preferably centralized within the radial space (52) to approximately equalize the amount or portions of the longitudinal gap (120) present on either side of the instrument insert (20). Thus, a portion of the total gap (120) is present on either side of the instrument insert (20) to permit the desired longitudinal movement of the instrument insert (20) relative to the outer member (26) in either direction. In other words, the amount or length of the total longitudinal gap (120) is selected depending upon the desired amount of travel of the instrument insert (20) longitudinally relative to the outer member (26).

In particular, the axial or longitudinal gap (120) is comprised of a first portion (122) and a second portion (124). The combination of the first portion (122) and the second portion (124) provides the total longitudinal gap (120) or amount of available travel of the instrument insert (20) within the radial space (52). Referring to FIG. 2, in the preferred embodiment, the first portion (122) of the longitudinal gap (120) is located or positioned between the first end (72) of the second insert portion (56) and the adjacent component of the tool (22), being a spacer kit (126), including one or more spacers, shims and/or springs, for an adjacent sub or tubular member (128). The second portion (124) of the longitudinal gap (120) is located or positioned between the second end (74) of the second insert portion (56) and the adjacent component of the tool (22), being an end of the housing insert (40) comprising the outer member (26).

Figure 5:
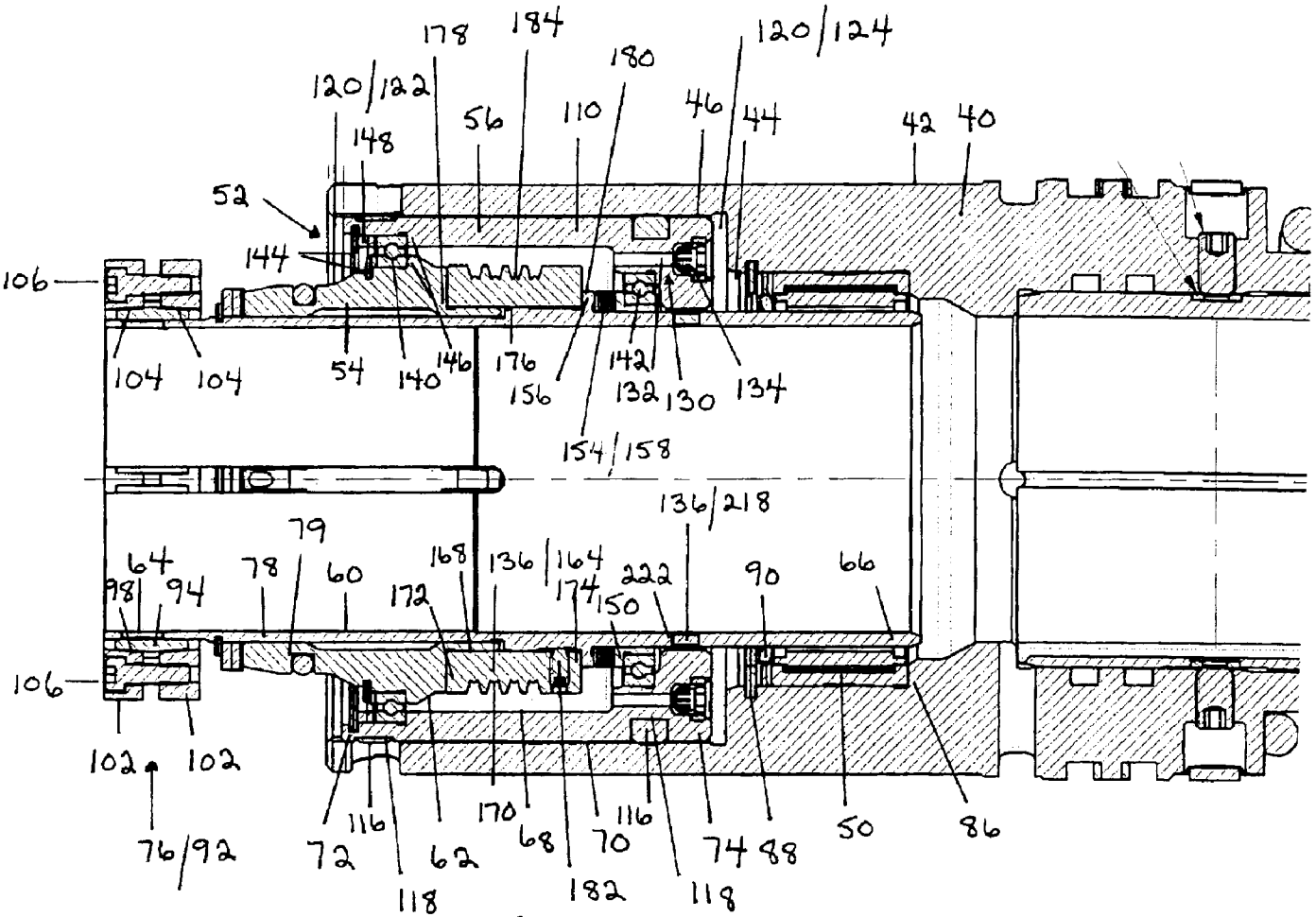
FIG. 5 is a longitudinal sectional view of the instrument insert and the portion of the outer member of the tool taken along line 5—5 of FIG. 3.

Further, in order to filter any fluid passing within the instrument insert (20) from outside the instrument insert (20), the instrument insert (20) is preferably further comprised of a filter mechanism (130), as particularly shown in FIGS. 4 and 5. The filter mechanism (130) preferably inhibits or prevents the passage of any debris or deleterious material, such as metal particles or filings from the tool (22), into the instrument insert (20) which may interfere with its proper functioning or the functioning of the instrument (21) associated therewith, as described further below.

The filter mechanism (130) may be comprised of any device or mechanism capable of filtering the fluid from the surrounding tool (22) for passage within the instrument insert (20). Further, the filter mechanism (130) may be associated with any part or element comprising the instrument insert (20). Preferably, the outer insert housing (110) is comprised of the filter mechanism (130) for filtering a fluid as the fluid passes from an exterior of the outer insert housing (110), being outside the instrument insert (20), to an interior of the outer insert housing (110), being within the instrument insert (20). In the preferred embodiment, the filter mechanism (130) is comprised of a fluid channel (132) defined by the outer insert housing (110) and extending from the interior of the outer insert housing (110) to the second end (74) of the second insert portion (56) to communicate with the exterior of the outer insert housing (110). In addition, the filter mechanism (130) is comprised of a filter material or screen (134) disposed within the fluid channel (122) adjacent the second end (74) of the second insert portion (56).

As previously indicated, the instrument insert (20) is further comprised of or associated with an instrument (21). Specifically, the structure of the instrument insert (20) permits the components of the instrument (21) associated therewith to be maintained in a fixed relative longitudinal position while the inner and outer members (24, 26) of the tool (22) are permitted to rotate and reciprocate relative to each other. Thus, the instrument insert (20) facilitates the proper operation and functioning of the instrument (21) associated with or comprising the instrument insert (20).

Referring to FIGS. 3–8, preferably, the first insert portion (54) is comprised of a first instrument component (136) of the instrument (21). Further, the second insert portion (56) is comprised of the second instrument component (138) of the instrument (21). In other words, the instrument (21) is comprised of the first instrument component (136) and the second instrument component (138). The coupling mechanism (58) connects the first insert portion (54) with the second insert portion (56) and maintains the first and second insert portions (54, 56) in a fixed relative longitudinal position. Accordingly, the first instrument component (136) and the second instrument component (138) are also maintained in a fixed relative longitudinal position.

The first insert portion (54) comprised of the first instrument component (136) and the second insert portion (56) comprised of the second instrument component (138) are maintained in a fixed relative longitudinal position by the coupling mechanism (58). Although the first insert portion (54) and the second insert portion (56) may be maintained in any fixed positions relative to each other, the second insert portion (56) is preferably fixed about all or a part of the first insert portion (54) such that at least a part of the outer surface (62) of the first insert portion (54) is opposed or adjacent to at least a part of the inner surface (68) of the second insert portion (56). Further, the second insert portion (56) is preferably fixed about the first insert portion (54) in a position such that the second instrument component (138) is opposed to the first instrument component (136).

In the preferred embodiment, the second insert portion (56) is fixed in a position about the first insert portion (54) such that the first and second ends (64, 66) of the first insert portion extend from the first and second ends (72, 74) of the second insert portion (56) respectively. Specifically, the mounting sleeve (78), defining the first and second ends (64, 66) of the first insert portion (54), extends from the first and second ends (72, 74) of the second insert portion (56). Further, the second insert portion (56) is fixed in a position about the first insert portion (54) such that the second instrument portion (138) and the first instrument portion (138) are opposed to each other to permit the functioning of the instrument (21) comprised of the components (136, 138).

The coupling mechanism (58) may be comprised of any device, apparatus, members or elements capable of, and suitable for, connecting the first and second insert portions (56, 58) and maintaining them in a fixed relative longitudinal position. Preferably, the coupling mechanism (58) performs this function, while also permitting the relative rotation of the first and second insert portions (54, 56) consequent to the relative rotation of the inner and outer members (24, 26) of the tool (22). Thus, the coupling mechanism (58) is preferably comprised of at least one bearing so that relative rotation of the inner member (24) and the outer member (26) results in relative rotation of the first insert portion (54) and the second insert portion (56), and thus relative rotation of the first instrument component (136) and the second instrument component (138).

In the preferred embodiment, the coupling mechanism (58) is comprised of a first coupling bearing (140) and a second coupling bearing (142). Each of the coupling bearings (140, 142) is preferably at least a radial bearing. However, in the preferred embodiment, each of the coupling bearings (140, 142) is a radial and a thrust bearing. More particularly, each of the coupling bearings (140, 142) is comprised of a four-point contact ball bearing. The coupling bearings (140, 142) may be positioned at any location between the first and second insert portions (54, 56) which does not interfere with the first and second instrument components (136, 138). However, preferably, the coupling bearings (140, 142) are positioned a spaced distance apart to enhance the stability of the instrument insert (20). In the preferred embodiment, the first coupling bearing (140) is positioned at, adjacent or in proximity to the first end (72) of the second insert portion (56), while the second coupling bearing (142) is positioned at, adjacent or in proximity to the second end (74) of the second insert portion (56). In addition, any mechanism, device or structure may be used to maintain each of the first and second coupling bearings (140, 142) in the desired positions between the first and second insert portions (54, 56).

In the preferred embodiment, the first coupling bearing (140) is positioned adjacent the first end (72) of the second insert portion (56) between the inner surface (68) of the second insert portion (56) comprised of the outer insert housing (110) and the outer surface (62) of the first insert portion (54) comprised of the outer sleeve (79). More particularly, the first coupling bearing (140) is held in the desired position by at least one retaining ring (144). Specifically, each of the outer insert housing (110) and the outer sleeve (79) defines a complementary opposed bearing shoulder (146) for engagement and abutment with the first coupling bearing (140). The first coupling bearing (140) is maintained in engagement or abutment with the opposed bearing shoulders (146) by one or more retaining rings (144) extending from one or both of the inner surface (68) of the outer insert housing (110) and the outer surface (62) of the outer sleeve (79). Further, if required, one or more spacers (148) may be positioned between the first coupling bearing (140) and the retaining rings (144) to provide a firm or secure engagement of the first coupling bearing (140) with the bearing shoulders (146).

In the preferred embodiment, referring particularly to FIG. 7, the second coupling bearing (142) is positioned more proximate to the second end (74) than the first end (72) of the second insert portion (56) between the inner surface (68) of the second insert portion (56) comprised of the outer insert housing (110) and the outer surface (62) of the first insert portion (54) comprised of the mounting sleeve (78). More particularly, the second coupling bearing (142) is seated within a bearing carrier (150) positioned between the second coupling bearing (142) and the mounting sleeve (78). Further, the outer insert housing (110) defines a bearing shoulder (152) for engagement or abutment with the second coupling bearing (142). Specifically, the second coupling bearing (142) is held in the desired position between, and in engagement with each of, the bearing shoulder (152) and the bearing carrier (150).

In addition, in order to enhance or facilitate the engagement of the second coupling bearing (142) with each of the bearing shoulder (152) and the bearing carrier (150), the bearing carrier (150) is preferably urged towards the second coupling bearing (142) by a biasing mechanism or device, such as a spring (154). In the preferred embodiment, the spring (154) is comprised of at least one wave spring. Preferably, the outer insert housing (110) further defines a spring shoulder (156) such that the spring (154) may be positioned between the spring shoulder (156) and the bearing carrier (150). Finally, if required, one or more spacers (158) may be associated with the spring (154) and positioned between the spring shoulder (156) and the bearing carrier (150) to enhance or facilitate the action of the spring (154). Alternately, the second coupling bearing (142), with or without the bearing carrier (150), may be held in the desired position by one or more retaining rings.

The instrument insert (20) is comprised of the first instrument component (136) and the second instrument component (138) for at least one instrument (21). However, the instrument insert (20) may include a plurality of first and second instrument components (136, 138) for a plurality of instruments (21). In the preferred embodiment, the instrument insert (20) is comprised of a first instrument component (136) and a second instrument component (138) for each of two instruments (21).

The instrument insert (20) may be comprised of any type of first and second instrument components (136, 138) for any type of instrument (21) desired to be mounted within the particular tool (22). However, the instrument insert (20) is particularly configured for use with an instrument (21) wherein it is desirable for the proper operation or functioning of the instrument (21) to maintain the first and second instrument components (136, 138) in a fixed relative longitudinal position while permitting an amount of relative longitudinal movement between the inner and outer members (24, 26) of the tool (22), and preferably permitting relative rotation between the inner and outer members (24, 26). Thus, the instrument (21) may be of any type wherein it is desirable to mount the first and second instrument components (136, 138) within the tool (22) while maintaining the first and second instrument components (136, 138) in a fixed relative longitudinal position. In the preferred embodiment, the instrument (21) is of any type wherein it is desirable to permit relative rotation between the first and second instrument components (136, 138) while maintaining the first and second instrument components (136, 138) in a fixed relative longitudinal position.

For instance, the instrument (21) may be comprised of a slip ring assembly (160) for transmitting electricity or an electrical signal, comprised of data communications and/or power, between the inner member (24) and the outer member (26). Thus, the instrument insert (20) comprised of the slip ring assembly (160) provides the ability to transfer or transmit power or data, such as instructions or information, between the inner and outer members (24, 26) of the tool (22). Further, the instrument (21) may be comprised of a rotation sensor apparatus (162) for sensing the relative rotation of the inner member (24) and the outer member (26). In the preferred embodiment, two instruments (21) are associated with the instrument insert (20), wherein one instrument (21) is comprised of the slip ring assembly (160) and the other instrument (21) is comprised of the rotation sensor apparatus (162).

Preferably, the ability of the instrument (21) to perform its particular function is not substantially or significantly affected or impaired by any relative longitudinal movement between the inner and outer members (24, 26) of the tool (22) such as may be experienced by downhole tools subjected to tension and compression as a result of various borehole conditions including vibration, temperature changes and pressure changes and the operation of the tool (22) including the weight-on-bit of a drilling tool. The instrument insert (20) is provided to accommodate or compensate for the relative longitudinal movement between the inner and outer members (24, 26) while maintaining the first and second components (136, 138) of each instrument (21) in a fixed relative longitudinal position, thus facilitating its proper operation or functioning. The instrument insert (20) particularly compensates for the movement by floating as a unit within the radial space (52) between the inner and outer members (24, 26). In particular, the instrument insert (20) floats, or is capable of longitudinal movement, relative to at least one of the inner and outer members (24, 26).

Where the instrument (21) is comprised of the slip ring assembly (160), the first instrument component (136) is comprised of one of a conductive slip ring (164) and a compatible electrical contact assembly (166) and the second instrument component (138) is comprised of the other of the conductive slip ring (164) and the electrical contact assembly (166). Preferably, for ease of maintenance and repair of the slip ring assembly (160), the first instrument component (136) is preferably comprised of the conductive slip ring (164) and the second instrument component (138) is preferably comprised of the compatible electrical contact assembly (166). Thus, in the preferred embodiment, the slip ring (164) rotates relative to the electrical contact assembly (166) upon the rotation of the first insert portion (54) consequent to the rotation of the inner member (24) of the tool (22) relative to the preferably substantially stationary outer member (26).

Referring to FIGS. 3–7, the conductive slip ring (164) may be comprised of any mechanism, device or structure capable of mounting with the first insert portion (54) and suitable for electrical contact with a compatible electrical contact assembly (166). Preferably, the slip ring (164) is comprised of a conductive tubular member mounted about the outer surface (62) of the first insert portion (54). The slip ring (164) may be mounted with the first insert portion (54) in any manner and at any position between the first and second ends (64, 64) of the first insert portion (54) permitting the slip ring (164) to engage the electrical contact assembly (166).

In the preferred embodiment, the slip ring (164) is mounted about the outer surface (62) of the first insert portion (54), comprised of both the outer sleeve (79) and the inner mounting sleeve (78), at a position between the first and second ends (64, 66). The tubular slip ring (164) has an inner circumferential surface (168) for mounting about the outer surface (62) of the first insert portion (54), an outer circumferential surface (170) for engaging the electrical contact assembly (166) and opposed first and second ends (172, 174). The outer surface (62) of the first insert portion (54) preferably defines an indentation (176) for receipt of the slip ring (164) therein. Further, one end of the indentation (176) is defined by a mounting shoulder (178) defined by the outer sleeve (79) of the first insert portion (54) and the other end of the indentation (176) is defined by a mounting shoulder (180) defined by the mounting sleeve (78) of the first insert portion (54).

Thus, to maintain the slip ring in the desired position, the slip ring (164) is positioned within the indentation (176) such that the first end (172) of the slip ring (164) abuts or engages the mounting shoulder (178) of the outer sleeve (79) and such that the second end (174) of the slip ring (164) abuts or engages the mounting shoulder (180) of the mounting sleeve (78). Further, as shown in FIG. 5, if desired, one or more set screws (182) extending between the slip ring (164) and the first insert portion (54) may be used to further secure the slip ring (164) in the desired position. The set screw (182) is positioned such that it does not interfere with the contact between the outer surface (170) of the slip ring (164) and the electrical contact assembly (166).

The outer surface (170) of the slip ring (164) is configured for engagement with the electrical contact assembly (166). Thus, the outer surface (170) may have any shape or configuration compatible with the desired electrical contact assembly (166). However, in the preferred embodiment, the outer surface (170) is comprised of at least one circumferential contact grooves (184). In the preferred embodiment, the outer surface (170) is comprised of four circumferential contact grooves (184), however, more or less circumferential contact grooves (184) may be used as desired or required to effect the desired electrical contact. The circumferential contact grooves (184) are preferably provided in a spaced, substantially parallel arrangement about the outer surface (170) and are provided to engage the electrical contact assembly (166) to transmit the electrical signal therebetween.

Finally, the electrical signal or electricity to be transmitted by the slip ring assembly (160) may be provided to or transmitted from the slip ring (164) in any manner suitable for conducting electricity. In the preferred embodiment, the first insert portion (54) defines an electrical conduit (186) therethrough to permit the passage of an electrical wire through the electrical conduit (186) for contact with the slip ring (164), as shown in FIG. 4.

Figure 8:
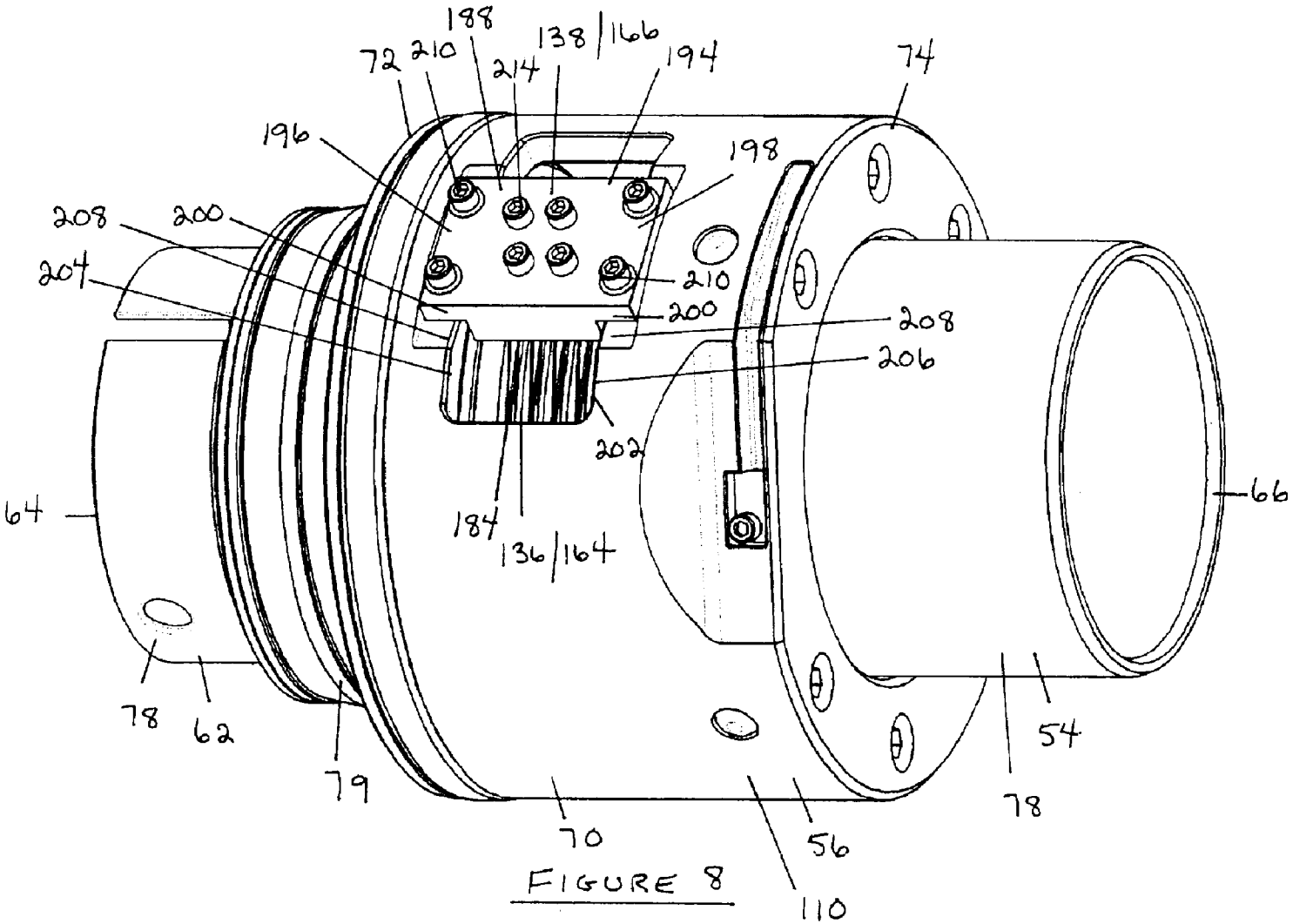
FIG. 8 is a perspective view of the instrument insert in isolation as shown in FIG. 7.

Referring particularly to FIGS. 4, 7 and 8, the electrical contact assembly (166) may be comprised of any mechanism, device or structure capable of mounting with the second insert portion (56) and suitable for providing an electrical contact with the slip ring (164). Preferably, the electrical contact assembly (166) is comprised of at least one brush block (188) mounted with the second insert portion (56) to oppose the slip ring (164). As discussed further below, the brush block (188) is comprised of at least one, and preferably a plurality of, electrical contact brushes or brush leads (190). The brush block (188) may be mounted with the second insert portion (56) in any manner and at any position between the first and second ends (72, 74) of the second insert portion (56) permitting the brush block (188), and particularly the electrical contact brushes (190), to electrically contact or engage the contact grooves (184) of the slip ring (164).

In the preferred embodiment, the first insert portion (54) and the second insert portion (56) are connected such that the slip ring (164) engages the electrical contact assembly (166). Further, the brush block (188) is particularly mounted with the outer insert housing (110) such that at least a portion of the brush block (188), and particularly the electrical contact brushes (190), extend or protrude from the inner surface (68) of the second insert portion (56). In the preferred embodiment, the brush block (188) has an inner surface (192) for protruding or extending from the inner surface (68) of the outer insert housing (110), an outer surface (194) and opposed first and second ends (196, 198). Each of the first and second ends (196, 198) of the brush block (188) defines a lip (200) for mounting with the outer insert housing (110) in the manner described below.

The outer insert housing (110) defines at least one opening (202) extending therethrough from the outer surface (70) to the inner surface (68) of the second insert portion (56) for receipt of a brush block (188) therein. Thus, the opening (202) has a size and configuration compatible with receipt of the brush block (188) therein such that the inner surface (192) of the brush block (188) and the electrical contact brushes (190) are capable of protruding or extending from the inner surface (68) of the second insert portion (56). Further, although the brush block (188) may be mounted within the opening (202) in any manner, each of a first side (204) and a second opposed side (206) of the opening (202) preferably define a lip (208) compatible with the lip (200) at each end (196, 198) of the brush block (188).

Specifically, the brush block (188) is positioned within the opening (202) such that the lips (200) on the first and second ends (196, 198) of the brush block (188) engage the compatible lips (208) on the first and second sides (204, 206) of the opening (200) in the outer insert housing (110). Accordingly, the brushblock (188) is suspended in the opening (202) in opposition to the slip ring (164). Further, in order to ensure that the lips (200, 208) remain in engagement, one or more screws (210) may extend through the lips (200, 208). In the preferred embodiment, four set screws (210) are provided. Two set screws (210) fasten the lips (200, 208) together at the engagement of the first end (196) of the brush block (188) and the first side (204) of the opening (202). Similarly, two set screws (210) fasten the lips (200, 208) together at the engagement of the second end (198) of the brush block (188) and the second side (206) of the opening (202). This manner of mounting the brush block (188) provides easy access to and removal of the brush block (188) in the event that repairs or replacement are required.

The electrical contact brushes (190) are configured for engagement or electrical contact with the contact grooves (184) of the slip ring (164). Thus, the electrical contact brushes (190) may have any shape or configuration compatible with the contact grooves (184). However, in the preferred embodiment, four circumferential contact grooves (184) are provided. Accordingly, the brush block (188) is comprised of at least four electrical contact brushes (190) or contact leads to engage the contact grooves (184) in order to transmit the electrical signal therebetween. However, more or less electrical contact brushes (190) may be provided as required to provide the desired electrical contact.

Each electrical contact brush (190) is comprised of at least one and preferably a plurality of fine conductive wires having an inner end (212) for engaging or contacting a single contact groove (184) and an opposed outer end (214). Each contact brush (190) extends through, and is mounted or fastened within, an opening or passage in the brush block (188) extending between the outer surface (194) and the inner surface (192) of the brush block (188). The inner end (212) extends from the inner surface (192) of the brush block (188) for engaging the contact groove (184). The outer end (214) extends from the outer surface (194) of the brush block (188) to provide an electrical contact point for the brush block (188) as discussed below. If desired, the brush block (188) or the contact brushes (190) may be spring-loaded or otherwise urged or biased in the direction of the contact grooves (184) to facilitate the electrical contact between the outer ends (214) of the contact brushes (190) and the contact grooves (184).

Finally, the electrical signal or electricity to be transmitted by the slip ring assembly (160) may be provided to or transmitted from the electrical contact assembly (166), and particularly the brush block (188), in any manner suitable for conducting electricity. In the preferred embodiment, an electrical wire is connected with the outer ends (214) of the electrical contact brushes (190). Further, the second insert portion (56) defines an electrical conduit (216) therethrough to permit the passage of the electrical wire through the electrical conduit (216) for connection with the electrical contact brushes (190) as described and as shown in FIG. 4.

Where the instrument (21) is comprised of the rotation sensor apparatus (162), the first instrument component (136) is preferably comprised of one of at least one magnet (218) and at least one compatible magnetic sensor (220) and the second instrument component (138) is preferably comprised of the other of the at least one magnet (218) and the at least one compatible magnetic sensor (220). In the preferred embodiment, the first instrument component (136) is comprised of at least one magnet (218) and the second instrument component (138) is preferably comprised of a compatible magnetic sensor (220). Thus, in the preferred embodiment, the magnet (218) rotates relative to the magnetic sensor (220) upon the rotation of the first insert portion (54) consequent to the rotation of the inner member (24) of the tool (22) relative to the preferably substantially stationary outer member (26).

Figure 6:
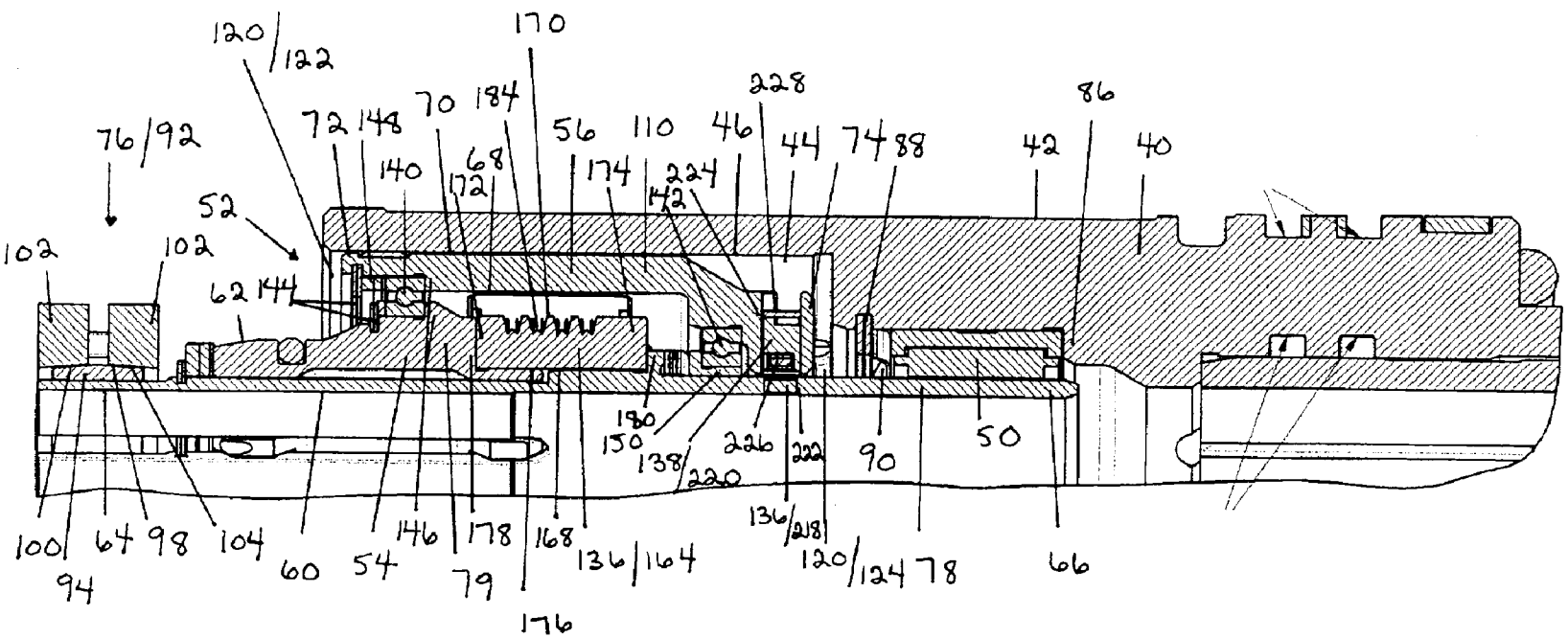
FIG. 6 is a longitudinal sectional view of the instrument insert and the portion of the outer member of the tool taken along line 6—6 of FIG. 3.

Referring particularly to FIG. 6, one or more magnets (218) may be mounted a spaced distance apart about the circumferential inner surface (60) of the first insert portion (54). In the preferred embodiment, at plurality of magnets (218) are mounted about the circumference of the outer surface (62) of the first insert portion (54) comprised of the mounting sleeve (78) at a position or location within the second insert portion (54). In particular, the magnets (218) are mounted with the mounting sleeve (78) to be positioned at, adjacent or in proximity to the second end (74) of the second insert portion (56) comprised of the outer insert housing (110). Each magnet (218) may be mounted with the mounting sleeve (78) in any manner permitting the magnet sensor (220) to sense the proximity of the magnet (218). Further, any type or configuration of magnet (218) capable of mounting within the first insert portion (54) and compatible with the magnetic sensor (220) may be used.

In the preferred embodiment, the magnet (218) is mounted within an indentation or cavity (222) defined by the outer surface (62) of the mounting sleeve (78) for each of the magnets (218). The indentation (222) is sized or configured for close receipt of the magnet (218) therein such that the magnet (218) is retained in the indentation (222) during use of the rotation sensor apparatus (162). Where required, other retaining or fastening mechanisms or devices may be used to retain, fasten or affix the magnet (218) within the indentation (218).

The magnetic sensor (220) may be comprised of any mechanism, device or structure capable of mounting with the second insert portion (56) and suitable for and capable of sensing the proximity of the magnet (218) to the magnetic sensor (220). Preferably, the magnetic sensor (220) is comprised of a position switch assembly used for determining the rotations per minute of the inner member (24). Any conventional or known magnet (218) and compatible position switch assembly (220) may comprise the rotation sensor apparatus (162).

Referring to FIG. 3–7, in the preferred embodiment, the first insert portion (54) and the second insert portion (56) are connected such that the magnetic sensor (220) is capable of sensing the proximity of the magnet (218) to the magnetic sensor (220). Further, the magnetic sensor (220) is mounted with the outer insert housing (110) such that the magnetic sensor (220) accesses or communicates with the inner surface (68) of the second insert portion (56). Further, the magnetic sensor (220) is positioned at, adjacent or in proximity to the second end (74) of the second insert portion (56) comprised of the outer insert housing (110). As a result, upon the rotation of the mounting sleeve (78) relative to the outer insert housing (110), the magnet (218) mounted within the mounting sleeve (78) is moved or rotated in a path which crosses or intersects with the location of the magnetic sensor (220) such that the magnet (218) opposes the magnetic sensor (220) in order to permit the magnetic sensor (220) to sense the proximity of the magnet (218) to the magnetic sensor (220).

In the preferred embodiment, the magnetic sensor (220) is mounted within a cavity, orifice or opening (224) defined by the outer insert housing (110) for receipt of the magnetic sensor (220) therein. The cavity (224) may extend through the outer insert housing (110) from the outer surface (70) to the inner surface (68) of the second insert portion (56) for receipt of the magnetic sensor (220). In any event, the cavity (224) is particularly sized or configured for close receipt of the magnetic sensor (220) therein such that the magnetic sensor (220) is retained in the cavity (224) during use of the rotation sensor apparatus (162). Where required, other retaining or fastening mechanisms or devices may be used to retain, fasten or affix the magnetic sensor (220) within the cavity (224).

Preferably, the magnetic sensor (220) has an inner end (226) mounted proximate to the inner surface (68) of the second insert portion (56) for sensing the magnet (218) and an opposed outer end (228). The outer end (228) is preferably mounted proximate to the outer surface (70) of the second insert portion (56) to provide an electrical contact point for the magnetic sensor (220). An electrical signal or electricity may be transmitted from or to the magnetic sensor (220) in any manner suitable for conducting electricity. However, in the preferred embodiment, an electrical wire is connected with the outer end (228) of the magnetic sensor (220). Further, the electrical conduit (216) defined by the second insert portion (56) preferably permits the passage of the electrical wire through the electrical conduit (216) for connection with the magnetic sensor (220) as described.

Finally, if required to ensure the proper operation of the instrument insert (20), the instrument insert (20) or the tool (22) may include one or more seal assemblies (not shown), preferably a rotary seal assembly, for containing a lubricant within the instrument insert (20) and, if desired, the surrounding components of the tool (22) in which the instrument insert (20) is mounted. Further, the rotary seal assemblies also preferably inhibit the passage of undesirable fluids, such as drilling fluid, into the instrument insert (20) and, if desired, the surrounding components of the tool (22). Any known or conventional seal assemblies may be used.

The embodiments of the invention in which an exclusive property or privilege is claimed are defined as follows:

1. An instrument insert for a tool of the type comprising an inner member extending within an outer member, the inner member and the outer member being capable of an amount of relative longitudinal movement, the instrument insert comprising:

(a) a first insert portion adapted to be connected with one of the inner member and the outer member, the first insert portion comprising a first instrument component of an instrument;

(b) a second insert portion adapted to be connected with the other of the inner member and the outer member, the second insert portion comprising a second instrument component of the instrument; and (c) a coupling mechanism for connecting the first insert portion with the second insert portion and for maintaining the first insert portion and the second insert portion in a fixed relative longitudinal position;

wherein the instrument insert is adapted for mounting within the tool at a radial position between the inner member and the outer member such that the instrument insert is capable of longitudinal movement relative to at least one of the inner member and the outer member.

2. The instrument insert as claimed in claim 1 wherein the inner member and the outer member are capable of relative rotation, wherein the first insert portion is adapted to be non-rotatably connected with one of the inner member and the outer member, wherein the second insert portion is adapted to be non-rotatably connected with the other of the inner member and the outer member, and wherein the coupling mechanism is comprised of at least one bearing so that relative rotation of the inner member and the outer member results in relative rotation of the first insert portion and the second insert portion.

3. The instrument insert as claimed in claim 2 wherein the instrument is comprised of a rotation sensor apparatus for sensing the relative rotation of the inner member and the outer member.

4. The instrument insert as claimed in claim 3 wherein the first instrument component is comprised of at least one magnet, wherein the second instrument component is comprised of a magnetic sensor for sensing the proximity of the magnet to the magnetic sensor, and wherein the first insert portion and the second insert portion are connected such that the magnetic sensor is capable of sensing the proximity of the magnet to the magnetic sensor.

5. The instrument insert as claimed in claim 4 wherein the first insert portion is adapted to be non-rotatably connected with the inner member and wherein the second insert portion is adapted to be non-rotatably connected with the outer member.

6. The instrument insert as claimed in claim 4 wherein the first insert portion is adapted to be non-reciprocably connected with the inner member so that the first insert portion moves longitudinally with the inner member and wherein the second insert portion is adapted to be reciprocably connected with the outer member so that the second insert portion moves longitudinally with the first insert portion, whereby the instrument insert is capable of longitudinal movement relative to the outer member.

7. The instrument insert as claimed in claim 2 wherein the instrument is comprised of a slip ring assembly for transmitting electricity between the inner member and the outer member.

8. The instrument insert as claimed in claim 7 wherein the first instrument component is comprised of a conductive slip ring, wherein the second instrument component is comprised of an electrical contact assembly for providing an electrical contact with the slip ring, and wherein the first insert portion and the second insert portion are connected such that the slip ring engages with the electrical contact assembly.

9. The instrument insert as claimed in claim 8 wherein the first insert portion is adapted to be non-rotatably connected with the inner member and wherein the second insert portion is adapted to be non-rotatably connected with the outer member.

10. The instrument insert as claimed in claim 9 wherein the first insert portion is adapted to be non-reciprocably connected with the inner member so that the first insert portion moves longitudinally with the inner member and wherein the second insert portion is adapted to be reciprocably connected with the outer member so that the second insert portion moves longitudinally with the first insert portion, whereby the instrument insert is capable of longitudinal movement relative to the outer member.

11. The instrument insert as claimed in claim 2 wherein the first insert portion is adapted to be non-rotatably connected with the inner member and wherein the second insert portion is adapted to be non-rotatably connected with the outer member.

12. The instrument insert as claimed in claim 11 wherein the first insert portion is adapted to be non-reciprocably connected with the inner member so that the first insert portion moves longitudinally with the inner member and wherein the second insert portion is adapted to be reciprocably connected with the outer member so that the second insert portion moves longitudinally with the first insert portion, whereby the instrument insert is capable of longitudinal movement relative to the outer member.

13. The instrument insert as claimed in claim 12, further comprising a first connecting mechanism for non-rotatably and non-reciprocably connecting the first insert portion with the inner member.

14. The instrument insert as claimed in claim 13 wherein the first insert portion is comprised of a mounting sleeve and wherein the mounting sleeve is adapted to surround the inner member.

15. The instrument insert as claimed in claim 14 wherein the first connecting mechanism is associated with the mounting sleeve for non-rotatably and non-reciprocably connecting the mounting sleeve with the inner member.

16. The instrument insert as claimed in claim 13, further comprising a second connecting mechanism for non-rotatably and reciprocably connecting the second insert portion with the outer member.

17. The instrument insert as claimed in claim 16 wherein the second insert portion is comprised of an outer insert housing and wherein the second connecting mechanism is comprised of one of a key and a keyway associated with the outer insert housing which is adapted to engage a complementary structure associated with the outer member for non-rotatably and reciprocably connecting the outer insert housing with the outer member.

18. The instrument insert as claimed in claim 16 wherein the instrument is comprised of a rotation sensor apparatus for sensing the relative rotation of the inner member and the outer member.

19. The instrument insert as claimed in claim 18 wherein the first instrument component is comprised of at least one magnet, wherein the second instrument component is comprised of a magnetic sensor for sensing the proximity of the magnet to the magnetic sensor, and wherein the first insert portion and the second insert portion are connected such that the magnetic sensor is capable of sensing the proximity of the magnet to the magnetic sensor.

20. The instrument insert as claimed in claim 16 wherein the instrument is comprised of a slip ring assembly for transmitting electricity between the inner member and the outer member.

21. The instrument insert as claimed in claim 20 wherein the first instrument component is comprised of a conductive slip ring, wherein the second instrument component is comprised of an electrical contact assembly for providing an electrical contact with the slip ring, and wherein the first insert portion and the second insert portion are connected such that the slip ring engages with the electrical contact assembly.

22. The instrument insert as claimed in claim 16 wherein the second insert portion is further comprised of an outer insert housing and wherein the outer insert housing is comprised of a filter mechanism for filtering a fluid as the fluid passes from an exterior of the outer insert housing to an interior of the outer insert housing.

* * * * *